US005222554A

United States Patent [19]

Blount et al.

[11] Patent Number: 5,222,554

[45] Date of Patent: Jun. 29, 1993

[54] WHIPSTOCK FOR OIL AND GAS WELLS

[75] Inventors: Curtis G. Blount, Wasilla; Javan D. Ottoson, Anchorage, both of Ak.

[73] Assignee: Atlantic Richfield Company, Los Angeles, Calif.

[21] Appl. No.: 828,258

[22] Filed: Jan. 30, 1992

[51] Int. Cl.[5] ..... E21B 7/06

[52] U.S. Cl. ..... 166/117.6

[58] Field of Search ..... 166/117.5, 117.6, 313, 166/281; 175/26, 61

[56] References Cited

U.S. PATENT DOCUMENTS

| | | | |
|---|---|---|---|
| 1,804,819 | 5/1931 | Spencer, Jr. et al. | 166/117.6 |
| 1,812,880 | 7/1931 | Kingback et al. | 166/117.6 |
| 2,324,682 | 7/1943 | Long | 166/117.6 |
| 2,445,100 | 7/1948 | Wright | 166/117.6 |
| 2,699,920 | 1/1955 | Zublin | 166/117.6 |
| 4,007,797 | 2/1977 | Teter | 175/26 |
| 4,153,109 | 5/1979 | Szecila | 166/117.6 X |
| 4,307,780 | 12/1981 | Curington | 166/117.6 X |

*Primary Examiner*—Ramon S. Britts
*Assistant Examiner*—Frank S. Tsay
*Attorney, Agent, or Firm*—Michael E. Martin

[57] ABSTRACT

A whipstock adapted for insertion into a wellbore through a tubing string having a smaller diameter than the wellbore casing or the open hole portion of the wellbore includes a setting mechanism comprising extendable legs which engage the wellbore wall to bias the whipstock into a position of inclination of the whipstock guide surface relative to the wellbore axis. The setting mechanism includes an actuating rod which may be actuated by a conventional downhole tool setting device to extend and retain the legs in their extended position. Cooperating ratchet means and tensionable couplings on the setting mechanism including a frangible coupling part permit actuation of the whipstock to its set position and retrieval of the setting device. The whipstock is releasable from the setting device by an adaptor having cooperating ball keys engageable with an adaptor actuating shaft and the upper end of the whipstock body.

19 Claims, 2 Drawing Sheets

WHIPSTOCK FOR OIL AND GAS WELLS

BACKGROUND OF THE INVENTION

1. Field of the Invention

The present invention pertains to a whipstock for oil and gas wells, particularly adapted for insertion into a well through a tubing string and including setting mechanism for positioning the whipstock guide surface after placement of the whipstock at a predetermined depth.

2. Background

The increased use of coilable tubing for performing well operations including "sidetracking" or drilling deviated wells from an existing wellbore has increased the need for a whipstock which may be inserted through a tubing string and then actuated to a set position upon exiting the lower end of the tubing string so that casing milling tools and drilling tools may be properly guided.

Improvements in drilling and coring operations and improvements in whipstocks for performing operations to drill and core with coiled tubing through existing well tubing strings are disclosed in U.S. patent application Ser. Nos. 07/752,704 and 07/752,705, both filed in the U.S. Pat. and Trademark Office on Aug. 30, 1991 and both assigned to the assignee of the present invention. Although application Ser. No. 07/752,705 discloses and claims a whipstock which may be inserted through a tubing string and set to provide proper orientation of the tool guide surface after exiting the lower end of the tubing string, the present invention provides further improvements in whipstocks which are particularly advantageously used for the methods described in the above-referenced patent applications as well as other applications where whipstocks may be required.

SUMMARY OF THE INVENTION

The present invention provides an improved whipstock for use in providing a tool guide surface in oil or gas wells and the like.

In accordance with one aspect of the present invention, a whipstock is provided which may be inserted into a well through a tubing string in the wellbore and, upon exiting the distal end of the tubing string may be actuated to set itself permanently in a position to orient the tool guide surface so that a tool may be guided into a position off the axis of the wellbore and to form additional wellbores or other penetrations into the earth formation.

In accordance with another important aspect of the present invention there is provided a whipstock which may be lowered into a wellbore at the lower end of a conventional setting tool and actuated to permanently position its guide surface at a prescribed angle with respect to the wellbore axis so that the guide surface may function properly to guide casing milling tools, core drills and other drilling tools to perform deviated wellbore drilling operations, core sampling, or other operations required when exiting the existing wellbore.

In accordance with still further aspects of the present invention, an improved whipstock is provided which has a unique actuating mechanism for urging the whipstock into the preferred position of its guide surface. The whipstock also includes a unique release mechanism for disconnecting the upper end of the whipstock from a setting tool and includes a unique setting mechanism which retains the whipstock securely positioned in the wellbore.

Those skilled in the art will recognize the above-described advantages and superior features of the present invention together with other important aspects thereof upon reading the detailed description which follows in conjunction with the drawing.

DESCRIPTION OF A PREFERRED EMBODIMENT

Figure 1:
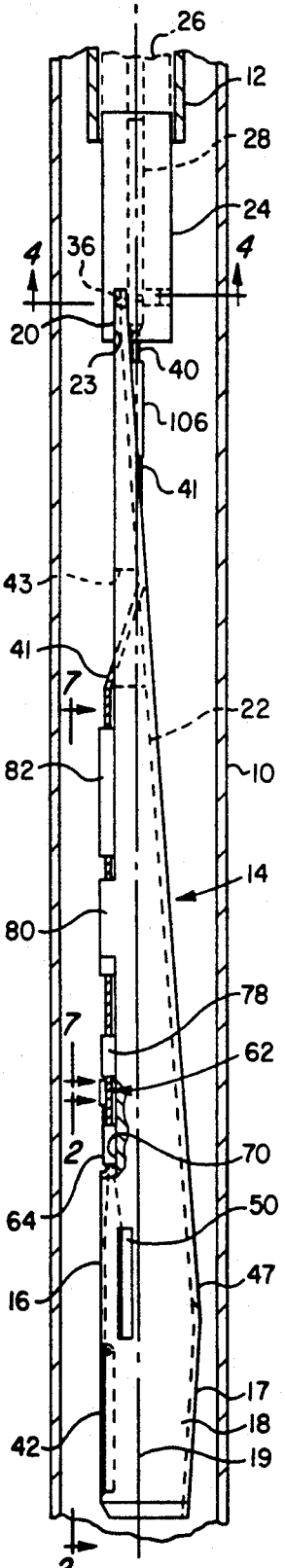
FIG. 1 is a side view of the whipstock of the present invention in position to be set to orient its guide surface within a well casing.

In the description which follows, like parts are marked throughout the specification and drawing with the same reference numerals, respectively. The drawing figures are not necessarily to scale.

Referring to FIG. 1, there is illustrated a portion of a wellbore casing 10 and a distal end of a tubing string 12 extending within the casing is also shown at the upper end of the drawing figure. In many instances it is desirable to exit an existing well through a cased or uncased portion without removing existing tubing strings such as the tubing string 12. In particular, the development of milling and drilling tools which may be extended into a wellbore within a tubing string and then used to exit the wellbore in a coring, side-tracking or other deviated hole operation, the requirement still exists for means to form a guide surface for the milling or drilling tools, such means being commonly known in the well drilling industry as a "whipstock". Conventional whipstocks are of such size and character as to preclude insertion into many wellbores through existing tubing strings that already extend within the wellbore, thereby necessitating pulling the tubing string(s) before the whipstock can be inserted and set in its desired position. This tubing pulling operation is not only expensive but in some instances may be virtually impossible to accomplish. Accordingly, there has been a strong need to develop a whipstock which may be inserted into a wellbore through a tubing string which is considerably smaller in diameter than the diameter of the well casing or even uncased lower portions of wellbores, and then set to properly position the whipstock guide surface.

Figure 4:
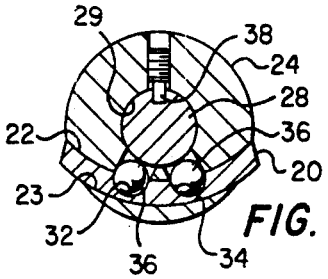
FIG. 4 is a detail section view taken along the line 4—4 of FIG. 1.
Figure 5:
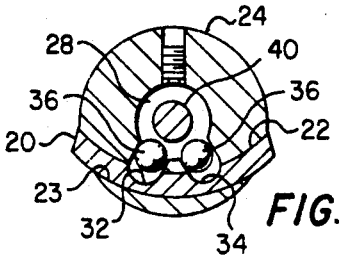
FIG. 5 is a view similar to FIG. 4 showing the whipstock body released from the setting tool.

Referring further to FIG. 1, there is illustrated an improved whipstock in accordance with the present invention and generally designated by the numeral 14. The whipstock 14 comprises an elongated, generally cylindrical body member 16 which is a substantially cylindrical member at its lower portion 18 but is tapered to form somewhat less than half a cylinder at its upper end 20. The body member 16 includes a somewhat concave, sloped guide surface 22 formed thereon as indicated in FIGS. 1, 4 and 5. Moreover, the diameter of the whipstock body member 16 is at least slightly less than the inside diameter of the tubing 12 so that the body member, together with other mechanism thereon, is configured to have sufficient clearance to be lowered through the tubing string to exit the lower end as illustrated and be placed in a position to be set as will be described further herein.

The upper end 20 of the whipstock 14 is shown secured to a generally cylindrical adaptor part 24 which may be connected to a conventional wireline type wellbore tool setting device, generally designated by the numeral 26. The setting device 26 may be of a type manufactured by Baker Packers Division of Baker Hughes, Inc. and known as their Model E4 Wireline Pressure Setting Assembly. Similar tools electrically and hydraulically energized, and which otherwise operate in the same general manner as the aforementioned device may also be used with the present invention. Suffice it to say that the setting device 26 is operable to actuate a cylindrical rod member 28, FIG. 1, to move upward, viewing FIG. 1, relative to the adaptor 24 which will effect operation of the whipstock 14 to be set in a desired position in the casing 10 and to be released from the adaptor as will be explained further herein.

Referring further to FIG. 1 and FIGS. 4 and 5, the upper end 20 of the whipstock 14 is disposed in a curved slot 23 formed in the adaptor 24 and has two spaced apart recesses 32 and 34 which are formed in the surface 22 as shown. Suitable ball keys 36 are adapted to be disposed in the recesses 32 and 34, as illustrated in FIG. 4, and are contained within suitable generally radially extending bores formed in the adaptor 24 to act as retaining keys to retain the upper end 20 of the whipstock connected to the adaptor. The shaft 28, which is slidably disposed in a bore 29 formed in the adaptor 24, holds the ball keys 36 in the recesses 32 and 34 as illustrated in FIG. 4. A shear pin 38, FIG. 4, is also engaged with the shaft 28 to prevent premature actuation of the shaft and loss of the ball keys 36 from their position for retaining the whipstock 14 connected to the adaptor. However, as illustrated in FIG. 5, if the shaft 28 is moved relative to the ball keys 36 to the position illustrated, a reduced diameter portion 40 of the shaft is adjacent to the ball keys allowing them to move radially toward the rod portion 40 and out of the recesses 32 and 34, thereby permitting movement of the adaptor 24 relative to the whipstock 14 and out of engagement therewith.

Figure 2:
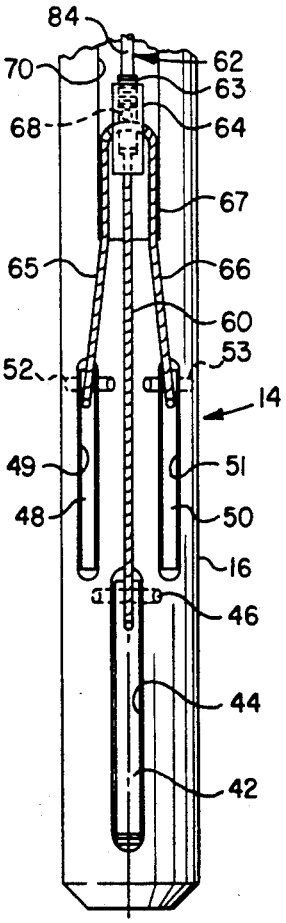
FIG. 2 is a detail elevation taken generally along the line 2—2 of FIG. 1.
Figure 3:
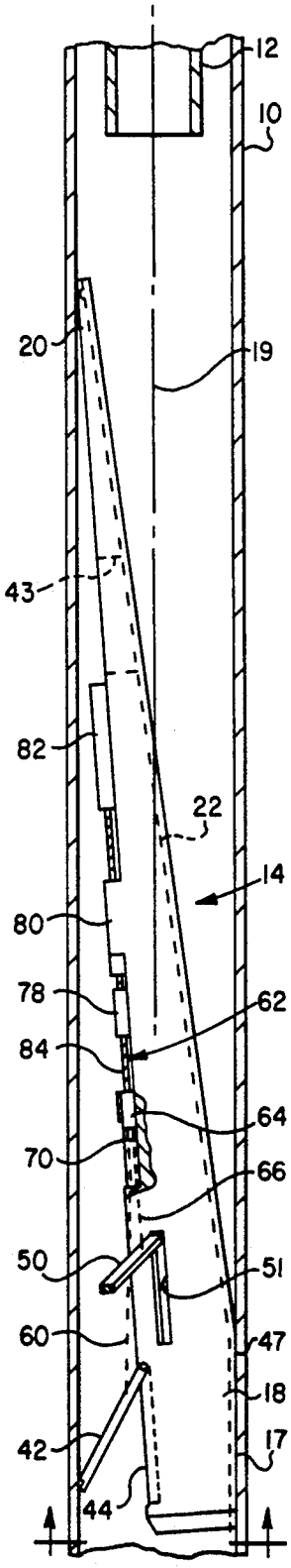
FIG. 3 is a view similar to FIG. 1 showing the whipstock in its set position.

Referring further to FIGS. 1 through 3, the whipstock 14 includes a unique setting mechanism which is characterized by a first pivotally supported setting leg 42 which is disposed on the body member 16 within a longitudinally extending slot 44, FIG. 2, and is supported for pivotal movement about pivot means 46 so that the leg may be extended into a casing engaging position as illustrated in FIG. 3 to urge the lower end 18 of the whipstock body 16 into engagement with the casing wall opposite the leg 42. A suitable inclined, flat or curved surface 17 is preferably formed on the body member 16 for engagement with the casing wall to properly position the guide surface 22 at an inclined position relative to the central longitudinal axis 19 of the casing 10, FIGS. 1 and 2. A fulcrum 47 is formed on the body 16 between the surfaces 17 and 22.

Figure 6:
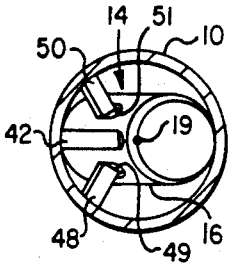
FIG. 6 is a view taken generally from the line 6—6 of FIG. 3.

The whipstock 14 also includes two secondary or stabilizing legs 48 and 50, FIG. 2, which are also pivotally mounted on the whipstock body 16 in respective longitudinally-extending slots 49 and 51. The legs 48 and 50 are supported on respective pivot means 52 and 53 for movement from a retracted position in the slots 49 and 51 into an extended stabilizing position as shown in FIGS. 3 and 6. As further shown in FIG. 6, the legs 48 and 50 are preferably disposed to pivot in planes which intersect the axis 19 at an angle of about 45° with respect to the pivot plane of the leg 42. In this way, the whipstock 14 may be urged into engagement with the casing 10 with its guide surface 22 inclined with respect to the axis 19 and the body member 16 stabilized in the deployed or set position by the stabilizing legs 48 and 50.

Referring further to FIGS. 1 and 2, the setting leg 42 and the stabilizing legs 48 and 50 are actuated to pivot from their retracted positions shown to their deployed positions shown in FIGS. 3 and 6 by an actuating mechanism including an elongated flexible cable 60. The cable 60 is suitably connected to the leg 42 and to an actuating rod 62 by way of a cable anchor member 64. The cable anchor 64 is also operably connected to a length of cable 66 which is trained through a suitable slot in the cable anchor 64 and is connected at its opposite ends to the legs 48 and 50, respectively. Both the cables 60 and 66 are connected to their respective legs at connection points which are between the distal ends of the legs which are operable to engage the casing wall and the respective pivot points of the legs so that tension on the cables 60 and 66 will move the legs from their retracted positions to their extended positions.

Referring to FIG. 2, the cable anchor 64 is threaded connected to the actuating rod 62 and is adapted to secure one end of the cable 60 to the anchor. The anchor 64 is also operable to adjust the slack on the opposed runs 65 and 67 of the cable 66. In this regard, the rod 62 has a threaded end part 63 which is threaded into the anchor 64 and bears against a ball cam member 68 disposed within the anchor and which bears against the cable 66. The cable 66 is trained through a suitable transverse slot formed in the anchor 64. The cable 60 is suitably becketed at its end opposite the end connected to the leg 42 for retention in the anchor 64. The anchor 64 is slidable along a flat 70 formed on the body 16 and the cables 60 and 66 may be trained through suitable slots formed in the surface of the body member 16 so that the cables are somewhat protected by the body during traversal through the tubing string 12 and into the setting position illustrated in the drawing.

Referring further to FIG. 1, the actuating rod 62 includes a coupling portion 78, which will be described in further detail herein, and the actuating rod extends through a boss 80 formed on the body 16 to a second coupling 82. The coupling 82 is connected to the rod 40 through an offset portion of the rod 40 as indicated by the numeral 41 whereby the rod 40 is aligned with both the coupling 82 and the shaft 28. A suitable slot 43 is formed in the whipstock body 16 to provide clearance for the rod portion 41 from alignment with the coupling 82 to alignment with the shaft 28, as shown in FIG. 1.

Figure 7:
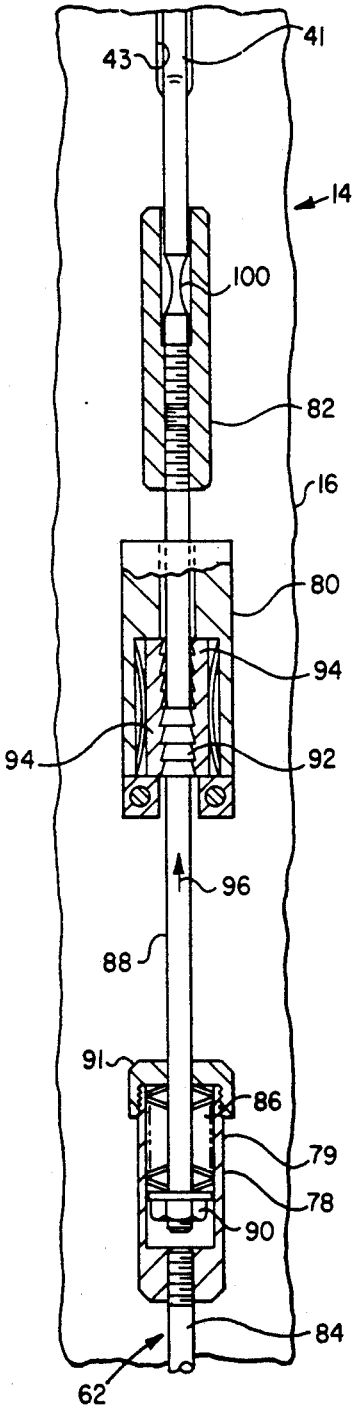
FIG. 7 is a view taken generally from the line 7—7 of FIG. 1.

Referring now to FIG. 7, the actuating rod 62 is further characterized by a rod section 84 interconnected between the anchor 64 and the coupling 78. The rod section 84 is threadedly connected to a body 79 of the coupling 78 which is formed as a hollow housing for retaining spring means 86 comprising a stack of Bellville washers which are sleeved over a section 88 of the actuating rod 62 having a suitable retaining nut 90 secured to one end thereof as illustrated in FIG. 7. A removable end cap 91 of the coupling 78 retains the spring means 86 within the coupling body 79.

The rod section 88 includes suitable ratchet means formed thereon in the form of serrations or wickers 92 which are cooperable with ratchet means formed on opposed wicker members 94 suitably disposed in the boss 80, as illustrated in FIG. 7. The wicker members 94 are spring biased into engagement with the wicker portion of the rod 88 so that the rod may move in the direction of the arrow 96 in FIG. 7 but is prevented from moving in the opposite direction by the cooperating ratchet teeth on the wicker members 94 and the wickers 92 formed on the rod 88.

The rod section 88 extends through the boss 80 and is threadedly coupled to the coupling member 82 as shown in FIG. 7. A further portion of the rod 62 comprising the rod section 41 is also threadedly coupled to the coupling member 82 and includes a frangible portion 100 which is responsive to a predetermined tension on the rod, exerted in the direction of the arrow 96, to effect separation of the rod section 41 from the coupling 82 at the frangible portion 100 so that the rod section 40 and the adaptor 24 may be withdrawn from the tubing string 12 while the whipstock 14 remains in its deployed position illustrated in FIG. 3.

Figure 10:
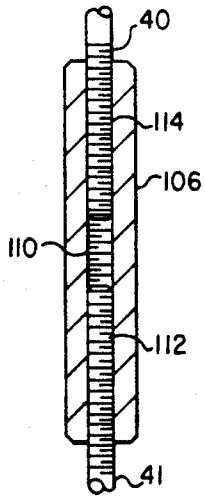
FIG. 10 is a detail view of a slack adjusting coupling.

Referring briefly to FIGS. 1 and 10, the actuating rod 40, 41 includes a slack adjusting mechanism characterized by a threaded coupling member 106 which is threadedly connected to the rod sections 40 and 41 as illustrated in FIG. 10. The coupling member 106 is provided with respective coarse threads 108 and fine threads 110 which have different lead angles. Corresponding threads 112 and 114 are formed on the rod sections 41 and 40, respectively. Upon assembly of whipstock 14 and its setting mechanism and prior to insertion into the tubing 12 the setting mechanism may be adjusted to take slack out of the cables 66 and 60 by adjusting the position of the coupling member 106 so that the setting mechanism is responsive to movement of the actuating shaft 28. Rotation of the coupling member 106 will, for example, advance the coupling member along the rod 41 at a faster rate than it is being threadedly uncoupled from the rod 40 so that a resultant shortening of the rod 40, 41 may be achieved to remove slack from the actuating and setting mechanism.

Operation of the whipstock 14 to be set in its working position shown in FIG. 3 will now be described. As previously mentioned, prior to insertion of the whipstock 14 into the tubing string 12 through suitable means at the surface of the well, not shown, the whipstock is connected to the adaptor 24 and the rod portion 41 is connected to the coupling 106 and adjusted so that there is little slack in the setting mechanism between the adaptor shaft 28 and legs 42, 48 and 50. Upon connection of the upper end 20 of the whipstock 14 to the adaptor 24 with the shaft 28 in the position shown in FIGS. 1 and 4, the whipstock is ready for insertion into the tubing string 12 suitably connected to the adaptor 24 and the wireline setting mechanism 26. When the whipstock 14 has been lowered through the tubing string 12 into the casing 10 to a predetermined depth, and suitably rotationally oriented about the axis 19 so that the guide surface 22 is facing a preferred direction with respect to an azimuth line lying in a plane normal to the axis 19, the setting tool 26 may be actuated.

Actuation of the setting tool 26 effects movement of the shaft 28 such that the shaft moves upwardly relative to the adaptor member 24, viewing FIG. 1. This movement will cause the entire actuating rod 62 to move upwardly relative to the whipstock body 16, viewing FIGS. 1, 2, 3 and 7. As the rod 62 moves the anchor member 64, the cables 60 and 66 actuate the legs 42, 48 and 50 to extend and urge the fulcrum 47 into engagement with the casing 10. The position of the fulcrum 47 relative to the legs 42, 48 and 50 will effect rocking of the body 16 about the fulcrum 47 so that surface 17 engages the casing wall, as shown in FIG. 3, and the surface 22 is inclined at the desired angle relative to the axis 19. The limiting position of the whipstock 14 is reached upon engagement of the body 16 at the surface 17 with the inner wall surface of the casing 10 or the wall surface of an open hole wellbore, not shown.

As the shaft 28 moves, as described, the rod 40 will move to a position adjacent to the ball keys 36 to permit same to move out of the recesses 32 and 34, thereby freeing the upper end 20 of the whipstock body 16 to be released from the adaptor member 24. Moreover, as the shaft 28 moves, as described, the rod 62 will translate in the direction of the arrow 96, FIG. 7, compressing the spring means 86 and moving the wickers 92 relative to the wicker members 94 to prevent movement of the shaft section 88 in the opposite direction to that of the arrow 96. When the tension in the rod 62 reaches the failure point of the frangible portion 100, the rod portion 41 will separate from the coupling 82 but the rod section 88 will not move in the opposite direction due to the ratchet means formed by the wickers 92 and 94. Moreover, the spring means 86 of the coupling 78 will continue to assure that tension remains in the rod 62 between the boss 80 and the anchor member 64 to keep the cables 60 and 66 in sufficient tension to bias the whipstock 14 into the position illustrated in FIG. 3.

After the afore-described setting operation is completed, the setting tool 26, adaptor 24 and rod 40, 41 may be withdrawn from the tubing string 12 and further operations may be carried out to, if desired, cement the whipstock in position. Such an operation, if needed, is followed by milling and drilling operations as described in the above-referenced patent applications.

Figure 9:
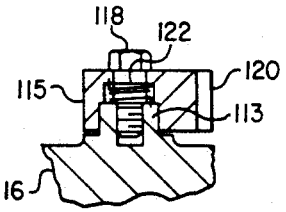
FIG. 9 is a detail section view taken generally along the line 9—9 of FIG. 8.
Figure 8:
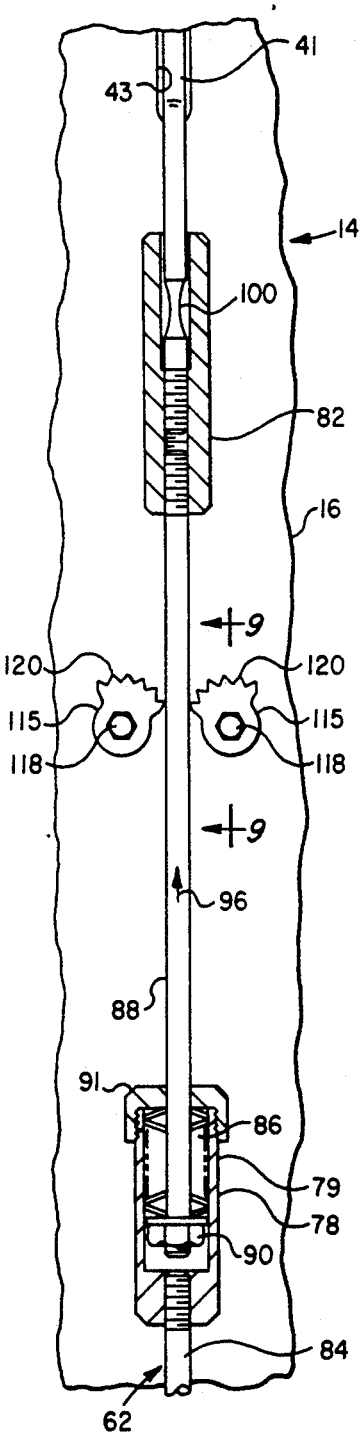
FIG. 8 is a view similar to FIG. 7 showing an alternate embodiment of mechanism for holding tension on the whips dock actuating rods.

Referring now to FIGS. 8 and 9, an alternate embodiment of a ratchet type mechanism for holding the actuating rod assembly in the actuated position of FIG. 3 is illustrated. The arrangement illustrated in FIGS. 8 and 9 may be used alone or in combination with the ratchet mechanism described and illustrated in FIG. 7. In FIGS. 8 and 9, the body 16 is modified to include spaced apart bosses 113, FIG. 9 for example, which are disposed on opposite sides of the rod section 88 and are adapted to pivotally support opposed toothed cam members 115 which are pivotally supported on the body members 16 by a threaded pivot pin 118. The pin 118 may comprise a conventional hexhead shoulder type screw which serves as a pivot for the cams 115. The cams 115 include spaced apart ratchet teeth 120 which are engageable with the rod section 88 to prevent movement of the rod section in a direction opposite to that of the arrow 96 in FIG. 8. Each of the cams 115 may be biased to engage the rod section 88 by a suitable biasing mechanism, such as a torsion coil spring 112, FIG. 9, engaged with the cam 115 and the boss 113. Accordingly, the cams 115 may permit movement of the rod section 88 in the direction of the arrow 96, but the teeth 120 engage the rod section to prevent movement in the opposite direction. The cams 115, sometimes known in the art as "rolling dogs" may be used as the sole means to prevent movement of the rod section 88 in the direction opposite to the arrow 96 or as a redundant mechanism in conjunction with the mechanism illustrated in FIG. 7 and described hereinabove.

The whipstock 14 may be constructed using conventional engineering materials for oil and gas well downhole devices and using conventional manufacturing processes to fabricate the respective components. Although a preferred embodiment of the whipstock 14 has been described in detail herein, those skilled in the art will recognize that various substitutions and modifications may be made to the whipstock without departing from the scope and spirit of the invention as recited in the appended claims.

What is claimed is:

1. A whipstock for insertion into a wellbore through a tubing string smaller in diameter than the diameter of said wellbore to guide wellbore tools and the like, said whipstock comprising:

body means including a guide surface formed thereon;

means on said body means for connecting said whipstock to a setting device for inserting said whipstock into a wellbore; and setting mechanism on said whipstock for urging said whipstock into a predetermined position in said wellbore to incline said guide surface with respect to the longitudinal axis of said wellbore comprising leg means pivotally connected to said body means and engageable with a wall of said wellbore to urge one end of said body means toward said wall of said wellbore to incline said guide surface with respect to said axis, an actuating rod operably connected to said leg means for moving said leg means from a retracted position on said body means to an extended position to urge said whipstock into said predetermined position in said wellbore, and a frangible coupling portion responsive to a predetermined tension exerted on said rod to separate said setting device from said whipstock to permit withdrawal of said setting device from said wellbore.

2. The whipstock set forth in claim 1 wherein:

said leg means comprises a support leg and at least one stabilizing leg pivotally supported on said body means for movement between extended and retracted positions, respectively.

3. The whipstock set forth in claim 2 herein:

said leg means comprises two opposed stabilizing legs pivotally supported on said body means.

4. The whipstock set forth in claim 3 wherein:

said support leg is disposed on said body means between said stabilizing legs.

5. The whipstock set forth in claim 2 including:

flexible cable means interconnecting said let means and said rod for moving said leg means to an extended position in response to movement of said rod.

6. A whipstock for insertion into a wellbore to guide wellbore tools and the like, said whipstock comprising:

body means including a guide surface formed thereon;

means on said body means for connecting said whipstock to means for inserting said whipstock into a wellbore;

an adaptor part for connecting one end of said whipstock to said means for inserting said whipstock into said wellbore and at least one ball key engaged with said means on said body means and responsive to movement of a shaft associated with a setting device to move from a position retaining said whipstock connected to said adaptor part to a position to release said whipstock from said adaptor part; and setting mechanism on said whipstock for urging said whipstock into a predetermined position in said wellbore to incline said guide surface with respect to the longitudinal axis of said wellbore.

7. A whipstock for insertion into a wellbore to guide wellbore tools and the like, said whipstock comprising:

body means including a guide surface formed thereon;

means on said body means for connecting said whipstock to means for inserting said whipstock into a wellbore; and setting mechanism on said whipstock for urging said whipstock into a predetermined position in said wellbore comprising leg means connected to said body means and moveable into engagement with a wall of said wellbore to urge said body means toward said wall of said wellbore to urge said body means toward said wall of said wellbore to incline said guide surface with respect to the longitudinal axis of said wellbore, and an actuating rod operably connected to said leg means for moving said leg means from a retracted position on said body means to an extended position to urge said whipstock into said predetermined position.

8. The whipstock set forth in claim 7 wherein:

said setting mechanism includes means associated with said rod for permitting movement of said rod in one direction to extend said leg means but preventing movement of said rod in the opposite direction to allow said leg means to retract.

9. The whipstock set forth in claim 8 including:

coupling means including spring means interconnecting said rod and said leg means to tension said rod upon actuation of said means for permitting movement in one direction to maintain said leg means urging said whipstock into said inclined position of said guide surface.

10. The whipstock set forth in claim 8 wherein:

said means for permitting movement in one direction comprises wicker means formed on said rod and cooperating wicker members supported on said body means to permit movement of said rod in only one direction during extension of said leg means.

11. The whipstock set forth in claim 8 wherein:

said means for permitting movement in one direction comprises opposed cam means disposed on said body means and engageable with said rod to permit movement of said rod in said one direction.

12. The whipstock set forth in claim 7 wherein:

said rod includes a frangible coupling portion interposed between a setting device and said leg means and responsive to a predetermined tension exerted on said setting mechanism by said setting device to separate said setting device from said whipstock to permit withdrawal of said setting device and a portion of said setting mechanism from said wellbore while leaving said whipstock in said predetermined position.

13. A whipstock for insertion into a wellbore to guide wellbore tools and the like, said whipstock comprising:

body means including a guide surface formed thereon;

means on said body means for connecting said whipstock to means for inserting said whipstock into a wellbore; and setting mechanism on said whipstock for urging said whipstock into a predetermined position in said wellbore comprising leg means including a support leg and at least one stabilizing leg pivotally supported on said body means for movement between extended and retracted positions, respectively, and moveable into engagement with a wall of said wellbore to urge said body means toward said wall of said wellbore to incline said guide surface with respect to the longitudinal axis of said wellbore.

14. The whipstock set forth in claim 13 wherein:

said leg means comprises two opposed stabilizing legs pivotally supported on said body means.

15. The whipstock set forth in claim 14 wherein:

said support leg is disposed on said body means between said stabilizing legs.

16. The whipstock set forth in claim 13 including:

flexible cable means interconnecting said leg means with an actuating rod for moving said leg means to an extended position in response to movement of said rod.

17. In combination, a whipstock for insertion into a wellbore to guide wellbore tools and the like comprising body means including a guide surface formed thereon, means on said body means for connecting said whipstock to means for inserting said whipstock into a wellbore, a setting mechanism including leg means movable to urge said whipstock into a predetermined position in said wellbore to incline said guide surface with respect to the longitudinal axis of said wellbore and actuator means operable to cause said leg means to urge said whipstock into said predetermined position, and means engageable with said means on said body means for releasably retaining said whipstock connected to said means for inserting said whipstock into said wellbore and responsive to operation of said setting mechanism to release said whipstock from said means for inserting said whipstock in said wellbore.

18. The combination set forth in claim 17 including:

means forming a fulcrum on said body means and engageable with said wall to pivot said body means to incline said guide surface.

19. The combination set forth in claim 17 wherein:

said means for releasably retaining said whipstock includes key means engaged with said whipstock and responsive to movement of a shaft associated with said setting mechanism for releasing said whipstock from connection to said means for inserting said whipstock in said wellbore.

* * * * *